United States Patent [19]

Troncoso

[11] Patent Number: 4,803,910

[45] Date of Patent: Feb. 14, 1989

[54] MULTIPLE FIRING GUN TRIGGER EXTENSION ASSEMBLY

[76] Inventor: Vincent F. Troncoso, 14090-6100 Rd., Montrose, Colo. 81401

[21] Appl. No.: 102,631

[22] Filed: Sep. 30, 1987

[51] Int. Cl.[4] ..... F41D 11/02

[52] U.S. Cl. ..... 89/27.3; 89/136

[58] Field of Search ..... 89/27.3, 136, 129.02; 42/69.01, 69.02, 69.03

[56] References Cited

U.S. PATENT DOCUMENTS

| | | | |
|---|---|---|---|
| 2,586,317 | 2/1952 | Fay . | |
| 2,671,287 | 3/1954 | Hayes . | |
| 2,841,908 | 7/1958 | Bourquin . | |
| 2,920,413 | 1/1960 | Marhefka et al. . | |
| 3,091,878 | 6/1963 | Savioli . | |
| 4,276,808 | 7/1981 | York | 89/136 |
| 4,514,923 | 5/1985 | Teel . | |
| 4,532,852 | 8/1985 | Hance et al. | 89/136 |
| 4,685,379 | 8/1987 | Troncoso | 89/136 |

FOREIGN PATENT DOCUMENTS

| | | | |
|---|---|---|---|
| 438214 | 12/1926 | Fed. Rep. of Germany | 42/69.01 |
| 684716 | 12/1939 | Fed. Rep. of Germany | 89/27.3 |
| 491353 | 8/1938 | United Kingdom | 89/27.3 |

*Primary Examiner*—Deborah L. Kyle
*Assistant Examiner*—Stephen Johnson
*Attorney, Agent, or Firm*—Donald E. Nist

[57] ABSTRACT

The assembly is adapted for use with a preferably semi-automatic gun. It includes a mounting block which is adapted to releasably clamp over the lower rung of a trigger guard bar and which bears a trigger-actuating component rotatably secured thereto. That component includes a supplemental trigger depending below the block and a number of spaced trigger-actuating fingers in the form of spokes or notches disposed in an arc on a plate bearing the supplemental trigger. A spring is trained around a stud on the block and has its opposite ends intercepting the fingers and the trigger of the gun to which the block is mounted. The spring acts as a trigger trip lever. Thus, the fingers during their rotation sequentially strike the spring which is rotatably secured to the block, the spring thereupon sequentially striking the gun trigger to effect the firing. The assembly is simple, durable and efficient.

8 Claims, 1 Drawing Sheet

MULTIPLE FIRING GUN TRIGGER EXTENSION ASSEMBLY

BACKGROUND OF THE INVENTION

1. Field of the Invention

The present invention generally relates to weapons and more particularly to an improved assembly which effects multiple firing of a gun.

2. Prior Art

Various semi-automatic weapons such as semi-automatic rifles, pistols and the like are currently available. With these weapons the triggers must be sequentially pulled in order to cause sequential firing of the gun. The speed of firing is limited by the time required by the gunner to squeeze the trigger, fire, release the trigger and repeat the sequence. Such firing is not very rapid. Such weapons can be rendered fully automatic by modifying their firing mechanism. By fully automatic is meant that once the trigger is in the firing position, the gun fires sequentially until the trigger is released. However, such weapons, except for military and certain law enforcement use, are generally illegal.

It would be desirable to provide a simple, efficient, inexpensive and durable device to enable a gunner to sequentially fire a semi-automatic weapon at an increased speed, without modifying the gun to the full automatic mode. For safety's sake and for sporting purposes, the device should limit the number of shots fired in a sequence to a reasonably small number, for example, 2–5 shots, with a pause or separate action being required before the sequence could be re-initiated. Such a device would be very helpful in hunting large, dangerous game such as African big game, grizzly bears and Kodiak bears and the like, where the hunter could be in serious danger from a charging animal if the hunter could not shoot the semi-automatic weapon rapidly and accurately enough.

SUMMARY OF THE INVENTION

The improved multiple firing trigger extension assembly of the present invention satisfies all the foregoing needs. The trigger extension assembly is substantially as set forth in the Abstract. Thus, the assembly may be fabricated of steel or the like and includes a mounting block, preferably rectangular or L-shaped and bearing a slot adapted to releasably receive the lower rung of a conventional gun trigger guard below the gun trigger. This block may be locked to the guard by screws or the like and rotatably bears a trigger-actuating component which includes a supplemental trigger below the block and a plurality of spaced trigger-actuating fingers disposed in an arc above the supplemental trigger. The fingers and supplemental trigger are connected to a plate depending from the block and rotatably secured thereto. A trip lever in the form of a spring is rotatably secured to the block and bears against the gun trigger and fingers so that it is sequentially struck by the fingers when they are rotated by the supplemental trigger thereby causing the spring to sequentially strike the trigger to provide the desired sequential multiple firing action.

In one embodiment the block is split into two parts through the slot and clamped at each end. In another embodiment, a coiled spring with straight ears at opposite ends thereof is used. A rubber band or the like can be used to releasably connect the spring to the gun trigger.

Further features of the improved multiple firing gun trigger extension assembly of the present invention are set forth in the following detailed description and accompanying drawings.

DRAWINGS

DETAILED DESCRIPTION

Figure 1:
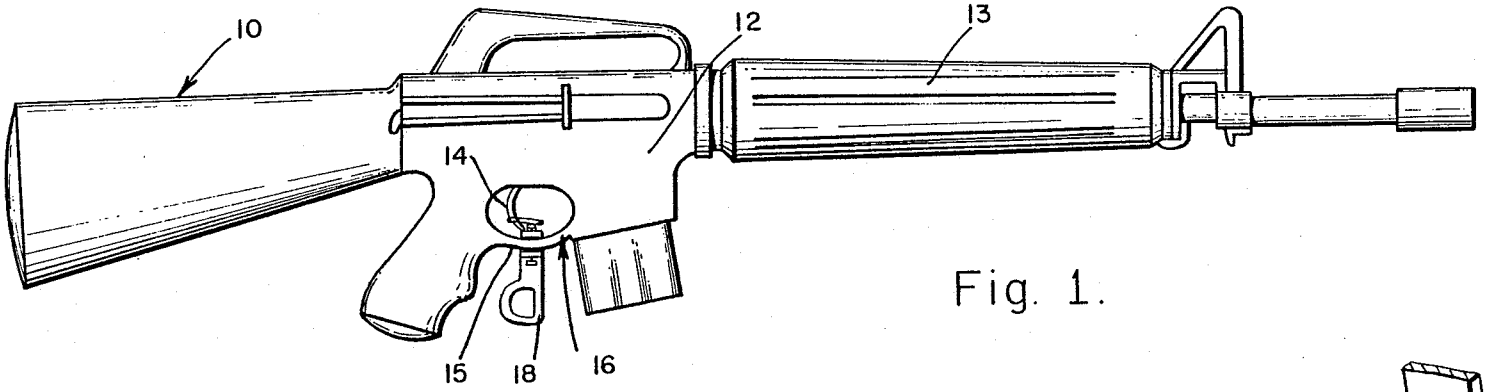
FIG. 1 is a schematic side elevation of a preferred embodiment of the multiple-firing trigger extension assembly of the present invention disposed on a semi-automatic rifle.
Figure 2:
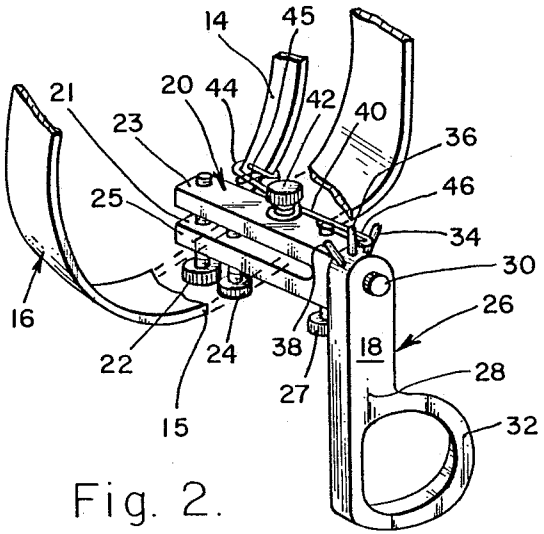
FIG. 2 is an enlarged schematic side perspective view, partly broken away, of the novel trigger extension assembly of FIG. 1.

FIGS. 1 and 2

Now referring more particularly to FIGS. 1 and 2 of the drawings, a first preferred embodiment of the trigger extension assembly of the present invention is depicted therein. Thus, a semi-automatic rifle 10 is shown, which is of standard construction, including a frame 12, barrel 13 and trigger 14, the latter being spring biased to the resting position. However, the lower part 15 of the trigger guard 16 of gun 10 bears the novel trigger extension assembly 18 of the present invention.

Assembly 18 includes (FIG. 2) an elongated about horizontal mounting block 20 bearing a horizontal slot 21 therein releasably receiving part 15 of trigger guard 16 and releasably clamped thereto by screw 22. An adjustment or set screw 24 can be provided to hold assembly 18 in the correct position. Block 20 may be split horizontally through slot 21 into two halves 23 and 25 held together by clamp screws 22 and 27 at opposite ends thereof.

Block 20 has a trigger-actuating component 26 rotatably secured thereto. For this purpose, block 20 has a vertical plate 28 rotatably secured by pin 30 to one end thereof and depending therefrom. Plate 28 bears a unitary integral supplemental trigger 32 in the form of a ring at its lower end and three spaced, upwardly projecting, narrow fingers or spokes 34, 36 and 38 disposed in an arc above trigger 32 at the top of plate 28.

Interposed between trigger 14 and fingers 34, 36 and 38 is a trip lever in the form of a spring 40 rotatably secured to block 20 by being trained around mounting screw or post 42 in block 20, with one end 44 thereof directly in front of trigger 14 and held thereagainst by a rubber band 45 and the opposite end 46 thereof in the path of rotation of fingers 34, 36 and 38. Rotation of plate 28 rearwardly by trigger ring 32 causes fingers 34, 36, and 38 to sequentially move forward and strike spring end 46, in each instance temporarily causing it to rotate forward around post 42, thereby causing opposite spring end 44 to bear rearwardly against trigger 14, causing it to fire. After firing, trigger 14 biases forward to the rest position as spring end 46 moves into a space between adjacent fingers 34, 36, and 38.

Thus, trigger 32 can be very rapidly pulled in the direction of the arrow in FIG. 2 to very rapidly cause fingers 34, 36 and 38 to sequentially push spring end 44 against trigger 14, with forward movements of trigger 14 therebetween, thereby very rapidly firing 3 shots from gun 10. Trigger 32 and fingers 34, 36 and 38 and spring 40 can then be reset for re-firing by pushing trigger 32 all the way forward. Sets of three shots each can rapidly follow upon each other. The single directional movement of trigger 32 to effect each set of three shots is considerably faster time-wise to make than having to move trigger 14 by hand back for each shot and allow it to recover forward in order to cause sequential firing of gun 10. Yet each set of shots is in assembly 18 is limited to three for safety purposes. Accordingly, improved multiple firing assembly 18 is of improved construction, performance and safety.

FIG. 3

Figure 3:
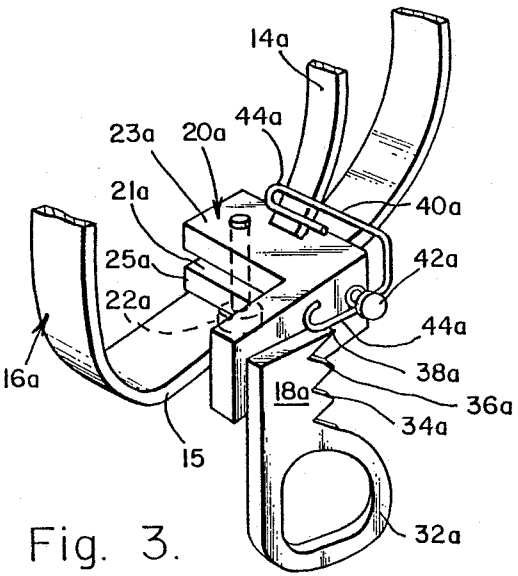
FIG. 3 is an enlarged schematic side perspective view, partly broken away, of a second preferred embodiment of the novel trigger extension assembly of the present invention; and, FIG. 4 is an enlarged schematic side perspective view, partly broken away, of a third preferred embodiment of the novel trigger extension assembly of the present invention.

A second preferred embodiment of the improved multiple-firing trigger extension assembly of the present invention is schematically depicted in FIG. 3. Thus, assembly **18*a* is shown. Components of assembly 18*a* which are similar to those of assembly 18** bear the same numerals but are succeeded by the letter "a".

Assembly **18*a* is substantially identical to assembly 18** except as follows:

a. assembly **18*a* has block 20*a* thereof L-shaped in plan view and not split into two halves; screw 22*a* alone being used to hold assembly 18*a* releasably to rung 15*a*;**

b. no rubber band 45 is present; end **44*a* of spring 40*a* merely rests against the front of trigger 14*a*;**

c. spring **40*a* is wound around stud 42*a* in the side rather than top of block 20*a* and spring 40*a* is three-angled with end 46*a*** extending forward rather than laterally;

d. the fingers of assembly **18*a* are notched teeth 34*a*, 36*a* and 38*a*,** rather than spokes.

Assembly **18*a* has substantially the same advantages as assembly 18**.

FIG. 4

Figure 4:
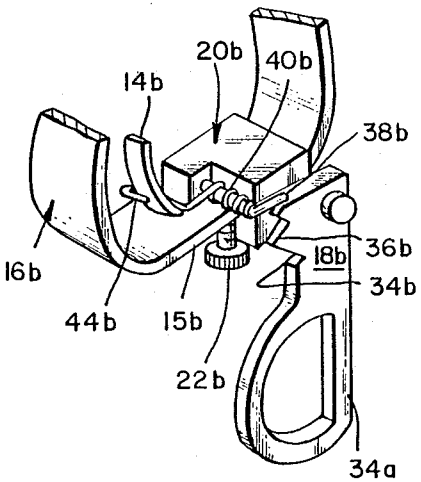

A third preferred embodiment of the multiple firing trigger extension assembly of the present invention is schematically depicted in FIG. 4. Thus, assembly **18*b* is shown therein. Components thereof similar to those of assembly 18 or 18*a*** bear the same numerals but are succeeded by the latter "b".

Assembly **18*b* is substantially identical to assembly 18*a*** except as follows:

Block **20*b* is generally rectangular but is notched out to receive coil spring 40*b* which has two flat ears 44*b* and 46*b* at opposite ends thereof. Assembly 18*b* is particularly compact for use with rifles and the like which have little clearance in which to mount assembly 18*b*. Assembly 18*b* has the advantages of assemblies 18 and 18*a*.**

Various modifications, changes, alterations and additions can be made in the improved multiple-firing trigger extension assembly of the present invention, its components and parameters. All such modifications changes, alterations and additions as are within the scope of the appended claims form part of the present invention.

PRIOR ART STATEMENT

A search of the prior art has not been made by applicant. Although applicant is generally aware of the existence of various types of devices to cause a semi-automatic gun to fire automatically, applicant does not know of any specific patent and literature relevant to the present invention, other than applicant's own U.S. Pat. No. 4,685,379 issued Aug. 11, 1987. Only that device is in any way similar to the present multiple firing assembly. That device is particularly adapted for use with an M-16/AR-15 rifle, as well as similar rifles. The present device is particularly adapted for other semi-automatic rifles. It will be noted that the number of firing fingers in the present device determine how many shots are fired in a sequence, so that the shots fired are limited in number and the gun is not converted into a fully automatic and therefore illegal weapon.

The device of U.S. Pat. No. 4,685,379, a copy of which is enclosed, includes a trigger guard bar which fits the M-16/AR-15 rifles but which must be substituted for the lower rung of a conventional gun trigger guard if applied to another rifle. In some instances that lower rung must be totally away in order to provide room for the guard bar. In contrast, in the present device, a mounting block bearing all other components of the assembly is releasably secured to an existing lower rung of a trigger guard, avoiding the necessity of having to alter the gun itself in any way and making the assembly instantly and uniquely transferrable from one gun to another, also to storage when it is not to be used. Accordingly, the present assembly is patentable over the known prior art.

What is claimed is:

1. A multiple firing gun trigger extension assembly for a semi-automatic gun having a trigger and trigger guard, said assembly comprising, in combination:

a. a mounting block having a slot for releasably receiving the lower portion of a gun trigger guard having an upper portion and a lower portion, said block including means for releasably securing said block to said trigger guard; and, b. a gun trigger-actuating component rotatably secured to said block and including i. a supplemental trigger below said block, moveable between a resting position and a sequential firing position, ii. a plurality of spaced trigger-activating fingers disposed in an arc along a path of travel above said supplemental trigger and rotatable therewith, and a trip lever comprising a spring releasably securable to a gun trigger in said trigger guard, and secured to said block, said spring having two opposite ends and an intermediate portion, one of said opposite ends being disposed in the path of travel of said trigger-activating fingers and rotatable thereby, the other of said opposite spring ends being releasably secured to said trigger and said intermediate portion of said spring being wound around a stud in said block, to effect sequential firing of a gun.

2. The assembly of claim 1 wherein said block is generally rectangular and wherein said releasable securing means include at least one set screw spanning said slot.

3. The assembly of claim 1 wherein said trigger-activating fingers are spokes connected to a plate bearing said supplemental trigger.

4. The assembly of claim 3 wherein said supplemental trigger comprises a trigger finger ring and wherein said plate is rotatably secured to and depends from one end of said block.

5. The assembly of claim 4 wherein said block is L-shaped and said spring is bent at an angle, wherein said assembly includes a rubber band and wherein said spring is releasably securable to said trigger by said rubber band.

6. The assembly of claim 4 wherein said spring is a coil trained around said stud with straight opposite ends of said spring intercepting said trigger and said spaced trigger-activating fingers.

7. The assembly of claim 2 wherein said slot is horizontal and wherein said block is split horizontally through said slot and has locking screws at opposite ends thereof.

8. The assembly of claim 1 wherein said trigger-activating fingers are notches integral with a plate bearing said supplemental trigger.

* * * * *